United States Patent [19]

Levy et al.

[11] Patent Number: 4,792,725

[45] Date of Patent: Dec. 20, 1988

[54] INSTANTANEOUS AND EFFICIENT SURFACE WAVE EXCITATION OF A LOW PRESSURE GAS OR GASES

[75] Inventors: Donald J. Levy, Berkeley; Samuel M. Berman, San Francisco, both of Calif.

[73] Assignee: The United States of America as represented by the Department of Energy, Washington, D.C.

[21] Appl. No.: 807,089

[22] Filed: Dec. 10, 1985

[51] Int. Cl.[4] ..... H01J 29/00

[52] U.S. Cl. ..... 315/39; 315/111.01; 315/248; 315/4; 315/111.21; 313/231.31; 313/485; 313/493; 313/231.61; 333/24 C; 333/32; 333/99 PL

[58] Field of Search ..... 315/DIG. 2, DIG. 5, 315/39, 111.21, 111.71, 5.39, 5.31, 5.32, 248; 313/490, 637, 638, 231.31; 333/24 C, 32, 33, 99 PL

[56] References Cited

U.S. PATENT DOCUMENTS

| | | | |
|---|---|---|---|
| 3,157,823 | 11/1964 | Clapp | 315/169 |
| 3,911,318 | 10/1975 | Spero et al. | 315/39 |
| 3,942,058 | 3/1976 | Haugsjaa et al. | 315/39 |
| 3,942,068 | 3/1976 | Haugsjaa et al. | 315/39 |
| 3,943,401 | 3/1976 | Haugstaa et al. | 315/39 |
| 4,010,400 | 3/1977 | Hollister | 315/248 |
| 4,049,940 | 9/1977 | Moisan et al. | 313/231.31 X |
| 4,178,534 | 12/1979 | McNeill et al. | 315/39 |
| 4,189,661 | 2/1980 | Haugsjaa et al. | 315/39 |
| 4,266,167 | 5/1981 | Proud et al. | 315/248 |
| 4,359,668 | 11/1982 | Ury | 315/39 |
| 4,427,920 | 1/1984 | Proud et al. | 315/39 |
| 4,427,923 | 1/1984 | Proud et al. | 315/248 |
| 4,427,925 | 1/1984 | Proud et al. | 315/39 |
| 4,480,213 | 10/1984 | Lapatovich et al. | 315/248 |
| 4,504,768 | 3/1985 | Ury et al. | 315/39 |
| 4,507,587 | 3/1985 | Wood et al. | 315/39 |

OTHER PUBLICATIONS

Moisan, "Description and Properties of an r.f. Plasma used for the Study of Parametric Interaction of a Strong E-M Field with Plasma," *Plasma Physics*, vol. 16, pp. 1-17, 1974.

Moisan et al., "The Theory and Characteristics of an efficient surface wave launcher (surtatron) producing long plasma columns," *Applied Physics*, vol. 12, 1979, pp. 219-237.

Moisan et al., "Density of Metastable atoms in an Argon Plasma produced by an rf Surface Wave," *Canada Journal of Physics*, vol. 55, 1977 pp. 1010-1012.

Moisan et al., "A Small Microwave Plasma Source for long Column Production without Magnetic Field," *IEEE Txns on Plasma Sci.*, vol. ps-3, No. 2, Jun. 75, pp. 55-59.

Zakrzewski, "Attenuation of a Surface Wave in an Unmagnetized RF Plasma Column," *Plasma Physics*, vol. 19, pp. 77-83, 1977.

*Primary Examiner*—David K. Moore
*Assistant Examiner*—Mark R. Powell
*Attorney, Agent, or Firm*—Clifton E. Clouse, Jr.; Roger S. Gaither; Judson R. Hightower

[57] ABSTRACT

A system for instantaneously ionizing and continuously delivering energy in the form of surface waves to a low pressure gas or mixture of low pressure gases, comprising a source of rf energy, a discharge container, (such as a fluorescent lamp discharge tube), an rf shield, and a coupling device responsive to rf energy from the source to couple rf energy directly and efficiently to the gas or mixture of gases to ionize at least a portion of the gas or gases and to provide energy to the gas or gases in the form of surface waves. The majority of the rf power is transferred to the gas or gases near the inner surface of the discharge container to efficiently transfer rf energy as excitation energy for at least one of the gases. The most important use of the invention is to provide more efficient fluorescent and/or ultraviolet lamps.

18 Claims, 3 Drawing Sheets

INSTANTANEOUS AND EFFICIENT SURFACE WAVE EXCITATION OF A LOW PRESSURE GAS OR GASES

The invention described herin was made under U.S. Department of Energy Contract No. DE-AC03-76SF00098 with the University of California for operation of the Lawrence Berkeley Laboratory.

BACKGROUND OF THE INVENTION:

The invention relates to energizing plasmas with surface waves, and more particularly, it relates to energizing a gas or gases contained in any discharge container that is operated at low pressures as a weakly ionized plasma, ssuch as a fluorescent lamp.

Although fluorescent lamps have been in use for many years and characteristically are relatively efficient, simple, reliable, durable and fast to operate, improvements in any or all of these characteristics are highly desirable.

Some of the principal limitations that prevent improvement of common fluorescent lamps include the requirements for electrodes, for starting circuit, and for a ballast. Electrodes, over time, degrade and contaminate the discharage container's inner surface with debris which causes dimming. Final electrode degregation leads to eventual failure. Both the starting circuit and ballast consume energy which does not contribute to light output. Therefore, the electrodes, ballast and starting circuit contribute to an ordinary fluorescent lamp's inefficiency. Moreover, both the starting circuit and the ballast wear out and eventually fail.

Another limitation of common or ordinary fluorescent lamps is self-absorption which is energy loss due to nonradiative decay within the lamp gas. Self-absorption may be explained by way of description of operation of such a lamp.

An ordinary fluorescent lamp consists of a ballast, starting circuit, and a glass discharge tube containing a mix of argon gas and mercury vapor with electrodes at each end of the tube. Starting a standard fluorescent lamp requires a special electrical circuit which supplies voltage adequate to start the ionization process. Once in operation, the mercury vapor is weakly ionized (1%), and the plasma electrons deliver energy to the un-ionized mercury atoms through collisions. During steady-state operation, the standard fluorescent lamp's ballast prevents current runaway. Power is delivered to the plasma electrons by an electric field generated between the tube electrodes. During the collisions of the electrons with the mercury atoms, the mercury atoms are both excited (i.e., given energy) and ionized. The excited mercury atoms lose their energy both by radiative and nonradiative decay. Most of the radiative decay takes place by the emission of a 2537 Angstrom, U. V. photon. when a U.V. photon of this wavelength interacts with the phosphor on the tube wall, the phosphor converts the U.V. energy to visible light. The energy of the nonradiative decay (de-excitation by electron collisions) of the mercury atoms does not contribute to producing light, and therefore represents a loss of useful energy. The nonradiative decay is principally due to quenching collisions with the plasma electrons. When a 2735 Angstrom U.V. photon is created in the lamp by radiative decay of a mercury atom, it travels a very short distance (<0.2 mm) before it excites and is reabsorbed by another mercury atom. This mercury atom either emits a U.V. photon or loses energy by electron collision.

The emission, re-absorption, and subsequent re-emission of a U.V. photon is repeated hundreds of times before the photon reaches the tube wall and produces light or before the energy initially created is lost by nonradiative decay. This energy loss due to nonradiative decay, will be referred to as energy loss as a consequence of self-absorption. The farther the initial excitation of a mercury atom is from the tube wall, the greater the self-absorption, and hence, the greater the amount of energy loss due to self-absorption. It is therefore an advantage to initially excite the mercury atoms near the discharge tube's inner surface and therby reduce energy loss due to self-absorbtion.

One way to accomplish this is to deliver the majority of the electric power to the mercury atoms near the discharge tube's inner surface. The delivery of the electric power provides intthe sense described above the initial excitation of the mercury atoms. Such an initial excitation condition (i.e., near the discharge tube's inner surface) can be achieved by use of radio frequency surface waves for which electrodes, starting circuits and ballasts are unnecessary. By way of comparison, the ordinary fluorescent lamp delivers the majority of the electric power to the center of the lamp's discharge tube. The ordinary fluorescent lamp also requires electrodes, a ballast, and a starting circuit.

Attempts have been made by others to construct a satisfactory fluorescent lamp that is energized by radio frequency energy, but non have tried surface waves. Much research effort by others has also been expended in energizing a low-pressure weakly-ionized plasma by means of radio frequency surface waves, but not for operation of a lamp, particularly a fluorescent lamp. Despite all of this prior work, no substantial improvements in characteristics of lamp operation have resulted.

SUMMARY DF THE INVENTION:

In brief, the invention is a concept for creating and sustaining a weakly ionized plasma contained in a discharge container in a manner that provides improved characteristics. To achieve these improved characteristics use is made of cylindrically symmetric radio frequency surface waves for initiating and sustaining the plasma. A novel energizer is provided for transferring energy from an rf power source to the plasma so efficiently as to provide instant initial ionization and subsequent electric power delivery necessary to sustain (i.e., energize and power) the created plasma. After initial creation of the plasma, the energizer delivers all the electric power generated by the rf source to the plasma in a cylindrically symmetric surface wave mode with no rf power reflected back to the rf generator.

It is an object of the invention to sustain a weaky ionized plasma highly efficienctly, so that nearly all of the rf energy is used to excite the un-ionized atoms.

Another object is to sustain a weakly ionized plasma in a cylindrically symmetric surface wave mode.

Another object of the invention is to transfer substantially 100% of the rf power from an rf power source to a plasma in a cylindrically symmetric surface wave mode.

Another object is to provide instant initial ionization of a low pressure gas or mixture of gases (including mercury vapor) contained in a discharge container upon application of energy to the container through an energizer.

Another object is to construct a surface wave lamp that is simple, efficient, inexpensive, and has a long lifetime.

Another object is to provide a surface wave lamp that does not require an ancillary starting circuit ballast, electrodes, or any moving parts.

Another object is to efficiently generate a high light output from small diameter tubes.

Another object is to provide as uniform as possible light output along the length of a surface-wave lamp discharge container.

Other objects and advantages of the invention will be apparent in a description of a specific embodiment thereof, given by way of example only, to enable one skilled in the art to readily practice the invention which is described hereinafter with reference to the accompanying drawing.

DESCRIPTION OF AN EMBODIMENT

Reference will now be made in detail to a present preferred embodiment of the invention, an example of which is illustrated in the accompanying drawing. While the invention will be described in connection with a preferred embodiment, it will be understood that it is not intended to limit the invention to that embodiment. On the contrary, it is intended to cover all alternatives, modifications, and equivalents as may be included within the spirit and scope of the invention as defined by the appended claims.

Figure 1:
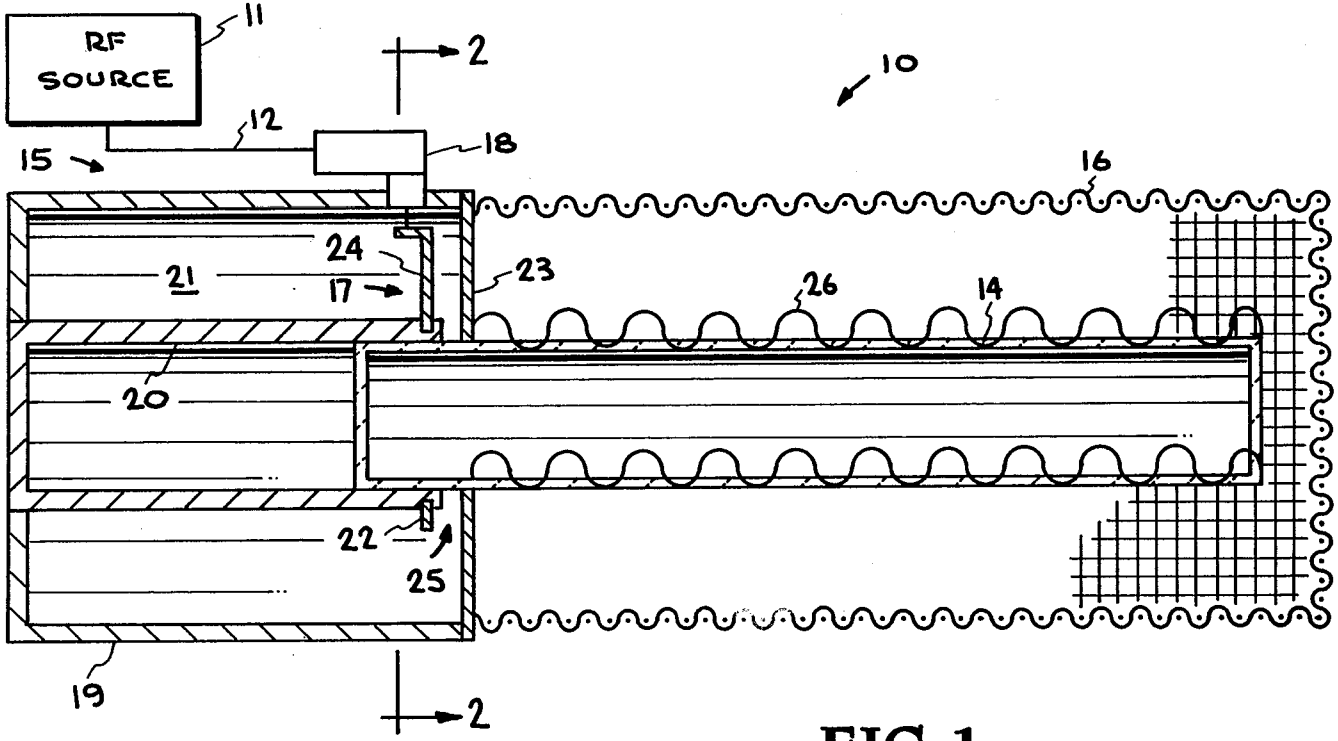
FIG. 1 is a diagram of a surface wave lamp system including an rf power source, transmission means, an energizer, a discharge tube, and a grounded transparent rf shield. With this system, surface waves are initiated and sustaieed according to the invention.

Referring to the drawing, there is shown in FIG. 1, according to the invention, a diagram of a surface wave lamp 10, connected to an rf source 11 over a constant impedance line 12, such as a standard coaxial line. The lamp includes a discharge tube 14 filled with a low-pressure ionizable gas or mixture of gases, a surface wave lamp energizer 15, a transparent and grounded rf shield 16. The energizer is made of electrically conductive material and includes a hollow outer cylinder 19 and a hollow inner cylinder 20 coaxially mounted within the outer cylinder. The inner cylinder 20 is cup-shaped with one end open and one end closed. An rf coupler 17 is provided and includes a disk 22 with a tail 24. The disk 22 has a central hole which is mated with a groove in the open end of the inner cylinder 20 and is electrically connected through the tail 24 to an impedance matcher 18 mounted through a standard connector in the outer cylinder 19. The rf coupler tail 24 extends perpendicularily from the inner cylinder 20 towards the outer cylinder 19. A front wall 23 is mounted on the end of the outer cylinder 19 opposite the open end of the inner cylinder 20 and spaced therefrom to define a gap between both the open end of the cylinder 20 and the disk 22 attached to that end. The rf coupler 17 is attached as near to the open end of the inner cylinder 20 as is mechanically possible. The front wall is provided with a hole that is coaxial with the inner cylinder. At least a portion of one end of the discharge tube 14 extends through the hole in the front wall 23 past the gap 25 and into the inner cylinder 20. A back wall 28, mounted on the outer cylinder 19 opposite the front wall 23 is in electrical contact with the inner cylinder 20. In combination with the front wall 23, the aack wall 28, the inner cylinder 19, and the outer cylinder 20 form a field shaping cavity 21.

In operation of the lamp 10, radio-frequency power is coupled to the tube 14 by application of power from the source 11 over the line 12 to the energizer 15 for interaction with the cavity 21. A high electric field is established thereby in the gap 25 between the front wall 23, the disk 22, and the open end of the inner cylinder 20. This field extends through the wall of the tube 14 and into the gas contained in the tube in the vicinity of the gap. The gas in the adjacent area is thereby at least partially inonized. Simultaneously, rf energy in the cavity 21 emerges as cylindrical symmetric surface waves 26 from the front wall 23 to propagate along the length of the tub 14 in the vicinity of the inner surface of the tube wall. (The depiction of the surface waves 26 is illustrative only and is not an accurate representation of actual waveforms.) The partial ionization of gas near the gap 25 permits the surface waves to nearly instantaneously propagate the ionization along the length of the tube to ionize and excite the gas and thereafter to maintain the gas excited and ionized (i.e. to sustain the plasma in a surface wave mode).

Thus, in summary of operation, the electromagnetic energy passes through the gap 25 and the surface waves propagate along and in the tube, transferring power to the plasma in the tube as they propagate. Most of the electromagnetic flux travels in the glass wall of the tube or in the free space immediately outside the inner and outer surface of the tube walls. The surface waves provide enough initial ionization to establish the plasma without an ancillary starting circuit. Once in operation, the surface wave lamp requires no ballast, as the current associated with the rapidly oscillating electrons is self-limiting. Collisions of the plasma electrons with mercury atoms result in the ionization and excitation of the mercury atoms in a set of processes analogous to those occuring in an ordinary fluorescent lamp. The key difference between a plasma column generated and sustained by surface waves and a plasma column found in an ordinary fluorescent tube is as follows: in a surface wave lamp the majority of the mercury atoms are excited near the tube surface close to the phosphor coating, whereas in an ordinary fluorescent tube the majority of the mercuyy atoms are excited at the center of the tube. This means that energy loss due to self-absorption is reduced in a surface wave lamp as compared to an ordinary fluorescent lamp. In addition, since there are no electrodes, lamp output does not diminish due to electrode degradation or due to contamination of the phosphor with electrode degradation debris. Thus, a surface wave fluorescent lamp according to the invention has an increased efficiency due to a reduction in self-absorption and due to elimination of electrodes, ballasts, and a special starting circuit.

The tube 14 may be anyone of at least three types of cylindrical discharge tubes. The discharge tube types, herein designated types (a), (b) and (c), may be defined by their contents including inner surface coating, if present.

Type (a) discharge tubes contain a mix of inert gases and mercury vapor (e.g. argon gas and mercury vapor). On the inner surface is a phosphor which converts 257 nm U.V. radiation to visible light. These are generic fluorescent lamp discharge tubes.

Type (b) discharge tubes contain a mix of inert gases and mercury vapor. They do not have a phosphor on the inner surface. If they are constructed of quartz glass, they can be considered generic germicidal or curing lamp discharge tubes, as they will be effective U.V. emitters when energized.

Type (c) discharge tubes do not contain mercury vapor but do contain a mixture of gases which can be weakly ionized. These tubes are especially useful for study of plasmas.

When energized by the surface wave lamp energizer 15, electrodes are not necessary in any of the three types of discharge tubes.

When either a type (a) or (b) discharge tube is inserted in the surface wave lamp energizer 15 and rf power is applied to the energizer, it provides a unique combination of three functions:

(i) It produces a cylindrically symmetric surface wave in the region enclosed by the rf shield 16.

(ii) It provides instant starting of the surface wave lamp without an ancillary starting circuit.

(iii) After starting, it is able to deliver substantially 100% of all the electric power generated by the rf source 11 to the discharge tube plasma. It does this without requiring a ballast.

The surface wave lamp energizer 15 performs these functions with no moving parts.

A surface wave lamp with either a type (a) or type (b) discharge tubes inserted in the surface wave energizer is more efficient than standard electrode-type lamps which utilize type (a) or type (b) discharge tubes because delivering power in the surface wave mode reduces U.V. self-absorption by the mercury vapor.

Since no electrodes are present or necessary in a surface wave lamp discharge tube, the radiative output from a surface wave lamp 10 with either a type (a) or type (b) discharge tube 14 does not diminish due to electrode degradation or contamination or the discharge tube inner surface with electrode debris. This diminution occurs in standard lamps whose discharge tubes have electrodes.

The surface wave energizer 14 will also produce surface waves in a type (c) discharge tube. The plasma generated in this mode is extremely stable with a very low noise level (i.e. fluctuations). This makes such tubes ideal for scientific study. In this mode there is also substanially 100% delivery of electric power to the plasma with no ballast or electrodes.

SURFACE WAVE MODE DISCUSSION

The surface wave mode discussed in connection with the invention is a high-frequency electromagnetic surface wave present both in and around the cylindrical discharge tube 4 when the gas or gasses in the tube are excited to be a plasaa. The tube may or may not be surrounded by the grounded, transparent rf shield 16. A prime feature of an electromagnetic surface wave, as applied to the invention, is that its electric field amplitude is greatest near the inner surface of the discharge tube. This electric field amplitude decreases rapidly both inside and outside the tube as the distance increases from the inner surface of the tube. Power is delivered to the plasma electrons by the rapidly oscillating electric field of the surface wave. The time average power delivered to the plasma per electron is given by the expression $$\frac{1}{2}\cdot\frac{e^2}{m}\left(\frac{\nu_c}{(2\pi f)^2+\nu_c^2}\right)|\vec{E}(\vec{r})|^2$$

where e=electron charge m=electron mass $\nu_c$=neutral collision frequency of electron f=frequency of rf power source $\vec{r}$=position $\vec{E}(\vec{r})$=amplitude of surface wave electric field As the above expression indicates, a surface wave delivers the maximum amount of electric power to the plasma near the inner surface of a plasma containment tube.

If a surface wave is initiated at one end of a tube it can damp out before reaching the other end; or if there is enough power supplied, it can extend to the far end of the tube and be reflected. For a given tube outer diameter, wall thickness, gas fill (e.g. argon gas and mercury vapor), length, and power delivered to the plasma, only a certain range of frequencies of the rf power source will produce well-defined surface waves. A well-defined surface wave is defined here as one whose electric field at the discharge tube inner surface is significantly larger than its electric field at the center of the discharge tube. A condition for propagation of a well-defined surface wave is $$\frac{4\pi e^2\bar{n}_e a^2}{m c^2\left[1+\left(\frac{\nu_c}{2\pi f}\right)^2\right]} \gtrsim 1$$

where e=charge on electron $\bar{n}_e$=average electron density a=discharge tube's inner radius m=electron mass c=speed of light $\nu_c$=neutral collision frequency of electron f=frequency of rf power source A suitable frequency range determined using the above equation is 50–1800 MHZ for typical values of the parameters $\bar{n}_e$, c, and a. These typical values may be found in Z. Zarzewski, M. Moisan, V. M. M. Glaude, C. Beaudry, and P. Leprince, 1977; "Attenuation of a surface wave in an unmagnetized rf plasma column," *Plasma Physics.* 19 p.p. 77–83; and in C. M. Ferreira, 1981; "Theory of a plasma column sustained by a surface wave." *Journal Phys. D: Appl. Phys.,* 14. pp 1811–30.

DESIGN PARAMETERS

In an actual embodiment of a lamp 10, according to the invention, the following parameters were determined for instant starting and efficient operation of the lamp:

1. At the launcher end of the plasma containing tube, wall thickness should be 0.5–1.0 mm for approximately the first 2 cm. This enhances instant starting.
2. Optimal (most energy efficient) operation is achieved if the tube wall thickness is uniform along the tube length and is 0.5–1.0 mm.
3. The cavity 21 and gap 25 should be cylindrical in order to propagate a cylindrically symmetric surface wave.
4. Typical ranges of values for the energizer 15 are:
   (i) inner cylinder 20: I.D. approximately 0.5 cm–4.5 cm, W.T. approximately 0.1588 mm;
   (ii) outer cylinder 19: I.D. approximately 1.0 cm–20 cm, W.T. approximately 0.3175 cm;
   (iii) overall length of cavity 21: approximately 2.0 cm–17 cm;
   (iv) gap 25 size: 0.5–5.0 mm; and
   (v) front wall 23 thickness: $\leqq$0.5 mm.

Figure 2:
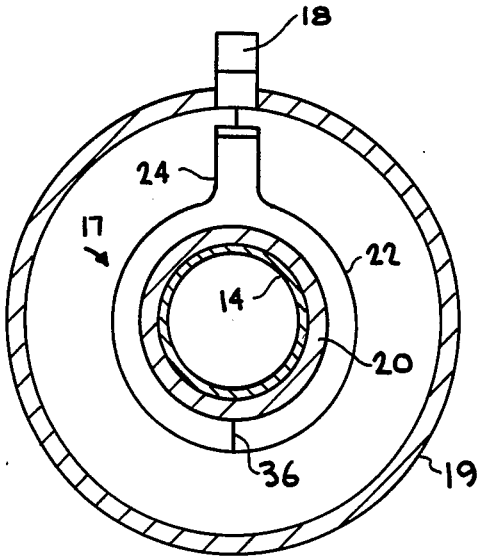
FIG. 2 is a cross-sectional view of the energizer of FIG. 1 taken along line 2—2.

The above dimensions are suggested ones and not to be constructed as all encompassing.
5. The rf coupler consists of a flat copper strip with the tail 24 in contact with or attached to the capacitive disk 22. The flat shape of the tail 24 minimizes self-inductance. The area of the disk 22 along with the gap distance determines the approximate contribution of the disk to the impedance of the surface wave fluorescent lamp. The rf coupler 17 is shown in greater detail in FIG. 2, which is a view taken along lines 2—2 of FIG. 1. The large flat area of the capacitive disk 22 that is required for proper impedance matching is estimated by carrying out impedance calculations as described hereinafter. These calculations require that the discharge tube 14 parameters, rf shield parameters, and rf power delivered to the lamp plasma be specified. The range of values for the capacitive disk is 0.0 $cm^2$ (no disk) to 180 $cm^2$. The shape and position of the rf coupler 17 are crucial to the proper performance of the energizer 15 and are also features of the invention.
6. The impedance matcher 18 is a small rf L-C circuit having an inductance and capacitance that are small compared to the inductance and capacitance of the field shaping cavity 21. For example, if the lit tube plus field shaping cavity have a capacitance of 50 microfarads then the capacitance of the impedance matcher would be approximately 0.5 microfarads.
7. In order to design the energizer 15, the total impedance of the system consisting of the energizer, discharge tube when energized in the surface wave mode, and rf shield must be specified such that this total impedance matches that of the means used to bring rf power from the rf source to the energizer.

Part of this specification requires specifying the parameters of the rf shield, the discharge tube, and the amount of power to be delivered to the tube.

8. Parameters for the discharge tube 14 include: outer diameter, wall thickness, length, type glass, and partial pressure (s) of gas or gases. In type (a) or type (b) discharge tubes the gases usually consist of a mixture of argon and mercury vapor. The ratio of input electric power to tube length should be approximately 0.39 watts/cm. With the above parameters specified, and using the proper combination of electromagnetic, plasma, and quantum mechanical calculations, the impedance of the surface wave lamp 15 (i.e. energizer, tube, and rf shield can be estimated as a function of the surface wave energizer's parameters and the frequency of the rf power source. The impedance ($Z_{SW1}$) of this system is given by $$Z_{sw1} = Z_{\text{impedance matcher}} + \frac{\left| \int_p \vec{E} \cdot \vec{dr} \right|^2}{\int_V \vec{J}\vec{E}^* \vec{dr} - \frac{if}{2} \int_V [\vec{E}^* \vec{D} - \vec{H}\vec{B}^*] dr}$$

where J, E, D, H, and B are the standard electromagnetic quantities found in Maxwell's equation or as defined in Jackson, *Classical Electrodynamics, Second Edition,* John Wiley and Sons, 1975. The integation volume V is over the entire volume enclosed by the rf shield 16 and field shaping cavity 21 including the gap region 25, the region between the gap and the discharge tube 14, as well as inside the discharge tube 14. The integration path (p) is between the two edges of the gap. In order to determine the above electromagnetic quantities, Maxwell's equations need to be coupled to a set of plasma and quantum mechanical equations in a manner similar to those presented in Ferreira, 1981, referenced hereinbefore.

In determining the optimal frequency for the rf power source 11 and optional dimensions for the surface wave energizer 15 and its component parts, four criteria were used:

(i) The impedance of the lamp 10 including the energizer 15, the energized discharge tube, and the rf shield 16 should be 50 ohms to match standard components.
(ii) The light output should be maximal for the specified input power level.
(iii) The light output should be as uniform as possible along the length of the tube.
(iv) The lamp should start instantly ($10^{-7}$ sec) when rf power is applied to the energizer 15 and either a type (a) or type (b) discharge tube is used. For each set of tube parameters and amount of electric power delivered to the lamp plasma, there will be at least one frequency which is optimal. This optimal frequency is a function of the tube parameters and the amount of the electric power delivered to the plasma.

LABORATORY MODELS

Figure 3:
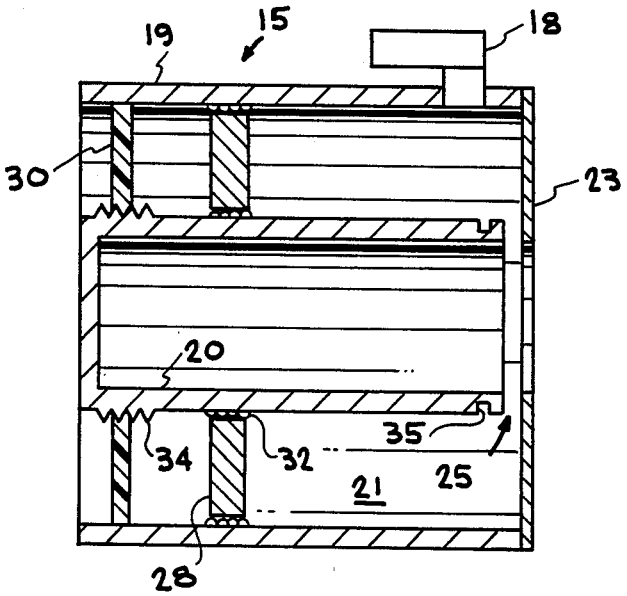
FIG. 3 is a longitudinal cross-sectional view of a laboratory model of an energizer having an adjustable tuning feature.

A laboratory model of the energizer 15, constructed in accordance with the invention, is shown in FIG. 3 in a cross-sectional view. The cylinders 19 and 20 are shown mounted coaxially. The cylinders are held in their relative positions by a rear wall disk 28 of electrically conductive material and by a plastic disk 30, both with central holes to receive the cylinder 20 therein. Inner and outer standard finger stock 32 is provided on the inner and outer radii of the back wall 28 in order to maintain tight and positive contact with both the inner cylinder 20 and outer cylinder 19 and to enable the rear wall 28 to be adjusted inwardly or outwardly to give the cavity a desired length.

The closed end of the inner cylinder 20 and the inner hole of the plastic disk 30 are threaded to enable the inner cylinder to be adjusted axially to achieve the desired length for the gap 25. In a production model, both the cavity length and gap length would be known so the energizer would be manufactured with both the back wall and inner cylinder in fixed positions.

The inner cylinder 20 is provided with a groove 35 on the open end towards the front wall for receiving the rf coupler disk 22. The groove 35 is as near the open end of the inner cylinder 20 as is mechanically possible. The disk 22 may be provided with a cut 36 so that the disk can be flexibly slipped over the end of the cylinder 20 and into the groove 35.

Figure 5:
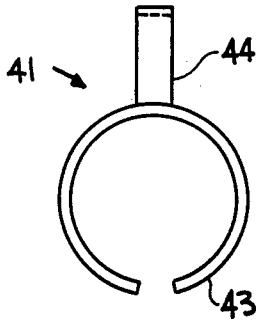
FIG. 5 is a front view of one part of the coupler of FIG. 4.
Figure 4:
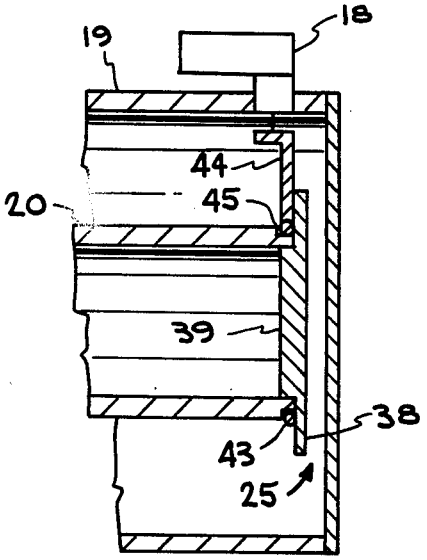
FIG. 4 is a partial view of an energizer with an alternate rf coupler for the laboratory model of FIG. 3.

In the FIG. 3 embodiment, the following dimensions were used:

Outer cylinder 19-
- length 13.8 cm
- inner diameter ~ 8.2 cm
- wall thickness ~ 0.32 cm Inner cylinder 20-inner diameter ~ 3.16 cm wall thickness 0.16 cm Slot 35-depth and width ~ 1 mm Front Wall 23—thickness ~ 0.5 mm Gap 25—Width variable from 0.5–5 mm Cavity 21—length variable from 1.8 cm to 12.5 cm rf coupler 17
- length tail 24 ~ 1.5 cm
- width tail 24 ~ 1.0 cm
- thickness tail 24 ~ 0.5 mm
- outer diameter disk 22 ~ 4.90 cm
- inner diameter disk 22 ~ 3.20 cm In an alternative embodiment, especially useful for laboratory for work for rapid and easy assembly and disassembly, an rf coupler disk 38 (FIG. 4) is provided that is separate from the tail. The disk 38 is provided with a shoulder 39 that either screws into or is snugly press fitted into the hollow of cyiinder 20. An electrical connector 41 (FIG. 5), including a split wire ring 43 and a flat tail 44 is positioned on the end of the cylinder 20 with the wire ring fitted into an "L"-shaped groove 45. The disk 38 holds the ring 43 firmly in the groove in reliable electrical contact with the cylinder 20, yet may be quickly disassembled. The rf coupler disks 22 and 38 are electrically equivalent in every way in operation of the invention.

In operation of a laboratory model of the invention, a standard 15 watt, 1" diameter, 18" long fluorescent discharge tube (a Sylvania F 15 TB/WW) was operated in the standard mode and then compared to its operation in the surface wave mode, according to the invention. In the surface wave mode, there was found to be an increase in light output that produced an increase in efficiency of 37%. The power level supplied to the lamp in each instance was 15.4 watts and when operated in the surface wave mode the frequency was 530 MHz.

ADDITIONAL FEATURES

Figure 6:
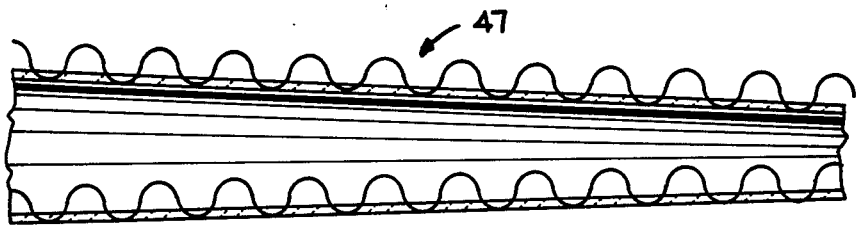
FIG. 6 is a view of a tapered tube for use in a surface-wave lamp, according to the invention.

In order to enhance the uniformity of radiation output from the discharge tube 14 when operated in accordance with the invention, the discharge tube may be replaced by a tapered tube 47 (FIG. 6) with a reducing taper from the end connected to the energizer 15 to the opposite end. With such an arrangement, as the surface wave energy is absorbed in the discharge tube as it travels from one end to the other, less energy is needed by each additional increment of tube length for a given amount of brightness at any location along the tube length since the tube diameter is smaller.

Uniformity of radiation output from the tube 14 may also be enhanced by arranging the length and impedance of the tube 14 to sustain a reflected surface wave from the opposite end to nearly the front wall 23, but not into the energizer 15. The reflected wave will excite and ionize the tube gas more fully in areas not fully energized by the original waves due to the peak intensities of the original and reflected wave being different.

Simplicity of structure of the rf shield 16 can be achieved by making it integral with the tube wall such as by coating the shield directly on the outside of the tube wall.

For many surface wave lamps placed in one building a single central rf power source could be provided to power a large number of the lamps. Coaxial transmission lines would also be provided for carrying the rf power from the power source to the various lamps.

It is to be understood that the foregoing description is merely illustrative of a preferred embodiment of the invention, that the scope of the invention is not to be limited thereto but is to be determined by the scope of the appended claims and that further examples of the invention and modification thereof will be apparent to those skilled in the art without departing from the spirit of the invention.

What is claimed is:

1. A fluorescent lamp illumination system for substantially instantaneously providing partial ionization of a low pressure fill of gas or mixture of gases in a tube and subsequent continuous excitation of said low pressure gas or gases in a surface wave mode for emitting light along the length of the tube, comprising:

a source of rf energy;

a fill of a permanent, particular volume of low pressure inert gas or gases and mercury vapor;

an elongated cylindrical tubular discharge container for confining said fill therein and having first and second closed ends and a cylindrical wall that is optically transparent to visible radiation, said wall having an inner surface and an outer surface, said container being permanently sealed to contain said fill, the inner surface of said discharge container being coated with phosphor said fill being in direct contact with said phosphor;

coupling means having a predetermined impedance and responsive to rf energy from said rf source to couple the energy to said fill to both ionize at least a portion of said fill to create a weakly ionized plasma and to deliver the rf energy in a surface wave mode to energize the fill to sustain the plasma, a majority of the energy being delivered through said wall to an area near said inner surface to thereby instantaneously ionize and substantially continuously excite said fill so that the majority of mercury atoms of the mercury vapor near said inner surface produce u.v. photons that interact with the phosphor to produce visible light, said container having said first closed end mounted within said coupling means with the remainder of said container extending from said coupling means, said closed second end being remote and external to said coupling means, said rf energy being delivered solely and only to said first end of said container, said rf energy being well-defined surface waves;

rf energy transmitting means having a predetermined impedance for transmitting rf energy from said source to said coupling means; and an rf shield around said container;

said coupling means having a predetermined impedance such that the total impedance of the combination of said coupling means, said rf shield, and said discharge container, when said fill is continuously ionized and excited, is matched to said predetermined impedance of said rf energy transmitting means, said predetermined coupling means impedance being partially matched to said rf energy transmitting means impedance when said fill is un-ionized, said partial matching being sufficient to instantly weakly ionize said fill upon application of rf energy from said source to said coupling means.

2. The system of claim 1, wherein said first closed end and an adjacent portion of said cylindrical wall of said container extend into said coupling means, said portion having a wall thickness in at least one predetermined area that permits penetration of rf energy from said coupling means into said fill to initially ionize at least a portion of said fill.

3. The system of claim 2, wherein the wall thickness in said predetermined area is less than or equal to 1.0 mm.

4. The system of claim 1, wherein said discharge container is a tube having a wall thickness that is uniform along its entire length and that is less than or equal to 1.0 mm for initial instant ionization and energy efficiency.

5. The system of claim 1, wherein said discharge container is a tapered tube with a well thickness less than or equal to 1 mm and having a large end and a small end and is tapered from the large end to the small end, said large end being in direct contact with said coupling means for initial instant ionization and an increased uniformity of power delivery along said tapered tube length.

6. The system of claim 1, wherein the said discharge container is a cylindrical tube of constant diameter.

7. The system of claim 1, wherein said discharge container is a tapered tube having a large end and a small end and is tapered from the large end to the small end, said large end being in direct contact with said coupling means.

8. The system of claim 1, wherein said system is adjusted to permit reflection of the rf energy from said closed second end of said discharge container to more uniformly ionize and excite said gas or gases.

9. The system of claim 1, wherein the frequency is in the range of 50–1800 MHz.

10. The system of claim 1, wherein the frequency is 530 MHz.

11. The system of claim 1, wherein said rf shield is integral with said discharge container wall.

12. The system of claim 1, wherein said rf shield enclosing said discharge container is transparent to ultraviolet radiation.

13. The system of claim 12, wherein said rf shield is integral with said discharge container wall.

14. The system of claim 1, wherein said coupling means includes an energizer comprising:

a hollow outer cylinder;

a hollow inner cylinder with one end open and one end closed, said inner cylinder being coaxially mounted within said outer cylinder;

an impedance matcher connected to said source of rf energy by said transmitting means;

an rf coupler comprised of a disk and a tail, said tail being flat and in electrical contact with said disk, said disk having a central hole and coaxially mounted on the open end of said inner cylinder, said rf coupler tail extending perpendicularly from said inner cylinder and electrically connected to said impedance matcher through a connector in said outer cylinder, said connector being located in said outer cylinder at the end of said outer cylinder closest to the open end of said inner cylinder;

a back wall contiguous with both said inner and outer cylinders and located at the closed end of the inner cylinder; and a front wall mounted on one end of said outer cylinder opposite the open end of said inner cylinder and spaced therefrom to form a gap between the open end of said inner cylinder and said rf coupler disk;

said front wall having a central hole coaxial with said inner cylinder for receiving said discharge container, said discharge container extending partially through said central hole and into the hollow portion of said inner cylinder past said gap, said gap being a location of high electric field upon application of energy from said rf source through said impedance matcher to said rf coupler for provision of instant partial ionization of said fill in the discharge container and for continuous delivery of the rf energy to the plasma in the surface wave mode subsequent to the initiation of ionization such that the majority of the rf energy provides full excitation of the fill contained in said discharge container.

15. The system of claim 1, wherein said transmitting means is a constant impedance line.

16. The system of claim 15, wherein said constant impedance line has an impedance within the range of 10–150 ohms.

17. The system of claim 16, wherein said constant impedance line is a coaxial cable having an impedance of 50 ohms.

18. The system of claim 14 wherein both the dimensions of the energizer, including the area of the rf coupler disk, and the impedance of the impedance matcher is such that the total impedance of the combination of said energizer, said discharger container, and said rf shield is matched to the impedance of the transmission means for bringing power from the rf energy source to the energizer such that upon application of rf energy instant partial ionization of the fill present in the discharge container is provided, and such that subsequent to initial ionization the rf energy is continuously delivered to the plasma in a cylindrically symmetric surface wave mode such that the majority of the rf energy is delivered to the plasma in a cylindrically symmetric surface wave mode such that the majority of the rf energy provides full excitation of the atoms of the fill.

* * * * *